United States Patent [19]

Oswald et al.

[11] Patent Number: 4,953,814

[45] Date of Patent: Sep. 4, 1990

[54] RAILWAY SWITCH COMPRISING A FROG HAVING A MOVABLE MAIN POINT AND AUXILIARY POINT

[75] Inventors: Johannes R. Oswald, Zeltweg; Eduard Guggenberger, Weisskirchen, both of Austria

[73] Assignee: Voest-Alpine Maschinenbau Gesellshaft m.b.H., Linz, Austria

[21] Appl. No.: 353,022

[22] Filed: May 17, 1989

[30] Foreign Application Priority Data

May 20, 1988 [AT] Austria ..... 1340/88

[51] Int. Cl.[5] ..... E01B 7/00; E01B 7/22

[52] U.S. Cl. ..... 246/382; 246/383; 246/385; 246/389

[58] Field of Search ..... 238/349; 246/382, 274, 246/275, 383, 385, 386, 387, 389, 392, 429, 430, 436, 435 R, 438, 442, 454, 468, 470, 472, 453, 458

[56] References Cited

U.S. PATENT DOCUMENTS

| | | | |
|---|---|---|---|
| 487,957 | 12/1892 | McAdams | 246/274 |
| 2,377,273 | 5/1945 | Siebert | 246/385 |

FOREIGN PATENT DOCUMENTS

| | | | |
|---|---|---|---|
| 0123666 | 10/1984 | European Pat. Off. | 238/349 |
| 0156349 | 10/1985 | European Pat. Off. | 238/349 |
| 6908819 | 6/1974 | Fed. Rep. of Germany . | |
| 0211594 | 7/1984 | Fed. Rep. of Germany | 238/349 |

*Primary Examiner*—Robert P. Olszewski
*Assistant Examiner*—Mark T. Le
*Attorney, Agent, or Firm*—Cushman, Darby & Cushman

[57] ABSTRACT

In a railway switch comprising a frog having a movable main and auxiliary point, the main and auxiliary point are formed by using thick-web standard rail sections and asymmetric tongue profiles of smaller height as compared with the thick-web standard rail sections which are arranged as outer wing rails. The difference in height between the height of the main and auxiliary points and the height of the outer wing rails is greater than the height of the rail feet of the main and auxiliary points.

5 Claims, 3 Drawing Sheets

RAILWAY SWITCH COMPRISING A FROG HAVING A MOVABLE MAIN POINT AND AUXILIARY POINT

BACKGROUND OF THE INVENTION

1. Field of the Invention

The invention refers to a railway switch comprising a frog having a movable main point and auxiliary point.

2. Description of the Prior Art

Frogs comprising a movable frog point and comprising a main point and an auxiliary point slidingly engaging the main point have, for example, become known from German Utility Model Patent No. 69 08 819. For the purpose of reliably obtaining the required flexibility of the frog points movable relative to one another, a great total length of the construction is necessary in such arrangements but the arrangements known up till now have a relatively low load carrying capacity and stability of the frog point. To achieve the required flexibility of the frog points, it was necessary to construct the main and auxiliary points without a rail foot over a large portion. This resulted in a severely impeded stability due to the reduced bearing surface. Therefore, there were restrictions relating to the use of construction materials and with respect to the feasability of differing geometrical designs of railway switches. A further drawback of the known arrangements resulted from the necessity to provide weld junctions and glued junctions in the course of the track, partially at an area not being chucked. An additional problem of known arrangements is the susceptibility to errors in the shape of the travelling edge. A relatively complicated design and a complicated locking system have been necessary for movable points known up till now.

SUMMARY OF THE INVENTION

The invention now aims at providing a railway switch of the initially mentioned type and having a movable frog, in which the switch can be used without limitation of construction materials that are usually employed in rail construction and in switch construction. The switch of the present invention is characterized by a greater load carrying capacity and stability, in particular within the area of the frog point. The switch according to the invention essentially consists of a main point and an auxiliary point that are formed by using standard rail sections having a thick web. There are arranged as the outer wing rails asymmetric tongue sections that having, as compared with the standard rail sections have a thick web, a lower height and being at least partially fixed on base plates. On account of using thick-web standard rail sections, the same construction material can be used for the main point as well as for the auxiliary point, so that uniform wear results and the maintainance costs become reduced. By selecting thick-web standard rail sections, the main point and the auxiliary point are provided with the required stability, and simultaneously, the possibility of elastic staying of the wing rail parts is improved. On account of the feature to give the outer wing rails a lower height compared with the height of the thick-web standard rail sections of the frog and to mount the outer wing rails at least partially on base plates, there is provided the possibility to secure the thick-web standard rail sections against a lifting movement of their foot portion located below the wing rails on occasion of a swivelling movement of the frog point. The thick-web standard rail sections thus reliably provide for the required strength. On account of the specific design of the outer wing rails, lifting movement of the frog point is reliably prevented. Such a construction is particularly advantageous in the case of railway switches being travelled upon at high speeds in which, when using different construction materials such as austenitic manganese steel castings, the required junctions or, respectively, track connections cannot be made without a high expenditure. On account of avoiding in the construction according to the invention a relatively rigid and non-flexible block, a more exact shape of the travelling edge can be obtained after having finished a switching operation, which is of particular importance in the case of high speeds and maximum speeds. An improvement of the exact shape of the travelling edge may in principle be achieved by subdividing the frog into a main point and an auxiliary point, but the proposals having become known up to this time considered the use of tongue sections, which resulted in the danger that the points, which have a lower height and have been subjected to strong mechanical working operation, are subjected to over-stress with respect to their load carrying capacity. The points formed of tongue sections must be subjected to mechanical work at their front area, so that the sections, which are weak per se, are further weakened.

For the purpose of further reducing the danger of a lifting movement of the frog point which already have a greater stability on account of the thick-web standard rail sections, the arrangement is advantageously selected such that the height of the asymmetric tongue sections having a smaller height is smaller for at least the height of the rail foot of the thick-web standard rail section of the frog point than the height of the thick-web standard rail sections of the frog point. In this manner, it becomes possible to shift the frog point, in its respective end position, with its foot portion of the thick-web standard rail section below the outer wing rails, which results in locking its position. In this case, the arrangement is advantageously selected such that the front sides, of the base plates, facing the frog point have recesses for gripping over the foot of the frog point when contacting the frog point.

So as not to detract from the stability in those areas in which such supporting action against lifting movement can not easily be realized, and for the purpose of simultaneously increasing the flexibility of the frog point, the arrangement is advantageously selected such that the foot of the frog point is, at least within the area of some of the base plates of the wing rails, recessed to have a smaller width.

The use of thick-web standard rail sections for the main point and the auxiliary point provides, however, also for a particularly stable sliding engagement of the auxiliary point on the main point at the run-off area of the frog. For the purpose of increasing the flexibility in such a case, there is advantageously selected at this location a sliding connection and the arrangement can, in a particularly simple manner be selected such that the main point and the auxiliary point are screw-connected by a screw extending through their mutually contacting surfaces. The hole provided in the main point and/or auxiliary point for the screw is provided with a supporting bushing and with spring elements, and is designed as an elongated hole extending in a longitudinal direction of the rail section. On account of the thick-web standard rail sections being used for the main point and for the auxiliary point, any weakening of the section by such elongated holes can be allowed without reducing the stability in an inadmissible manner. As a whole, there results, on account of this measure, a particularly exact shape of the travelling edge within the area of the frog point, the shape of the travelling edge making the frog point particularly suitable for use in high speed railway switches.

BRIEF DESCRIPTION OF THE DRAWING

The invention is further explained with reference to a preferred embodiment shown in the drawings.

In the drawings.

DETAILED DESCRIPTION OF THE PREFERRED EMBODIMENT

Figure 1:
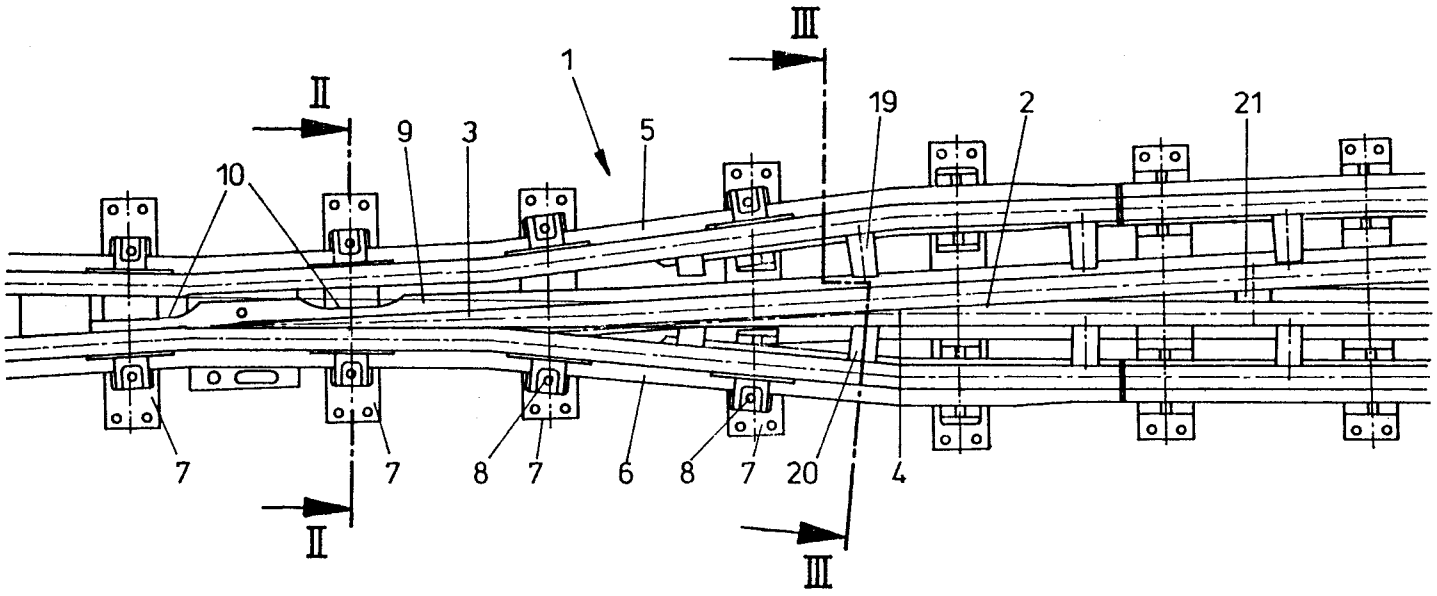
FIG. 1 shows a partial view of a top plan view of an inventive railway switch comprising a frog point having a movable main point and auxiliary point.

In FIG. 1, there is shown a frog designated by the reference numeral 1 and having a frog point 2 comprising a main point 3 and a auxiliary point 4. The wing rails of the frog 1 are designated by the reference numerals 5 and 6. The wing rails 5 and 6 are fixed on sleepers 7 by means of screws 8 in a manner to be explained later in greater detail. The foot 9 of the main point 3 has recesses 10 partially provided within the mounting area of the wing rail 5 on a sleeper 7, the purpose of said recesses being later explained in greater detail.

Figure 2:
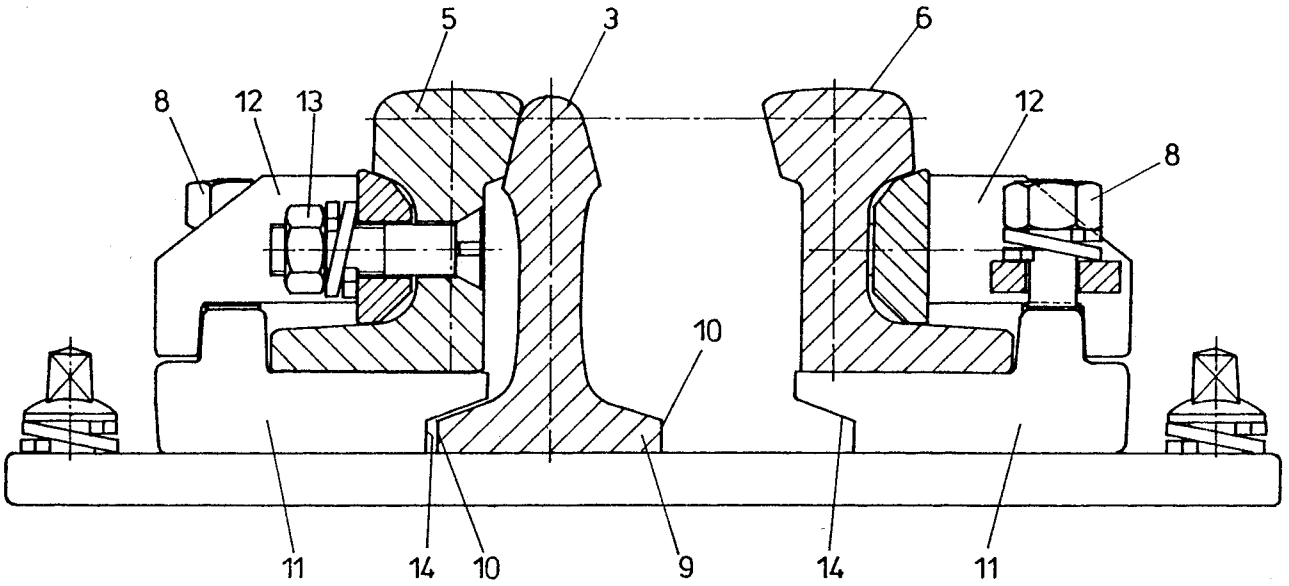
FIG. 2 shows a cross-section along the line II—II of FIG. 1, noting that the tongue rail is shown in a different position.

In FIG. 2, the main point 3 is shown in its position engaging the wing rail 5. The main point is, in this case, formed of a thick-web standard rail section, for example UIC 60 according to UIC 861-3V but with a web thickness of 30 mm or UIC 54 "profile A" according to UIC 861-2V having a web thickness of 28 mm. Also the asymmetric wing rail parts 5 and 6 being given a smaller height are adapted to the rail section used for the frog point, for which purpose there can, for example, be used an asymmetric tongue section for UIC-rail 60 kg/m according to UIC 861-2V or a "profile B 68.5 kg/m" according to UIC 861-2V. The wing rails 5 and 6, respectively, are mounted on base plates 11 having such a height that the total height of the base plate 11 and the added height of the wing rail 5 or, respectively, 6 having a smaller height corresponds to the height of the main point 3. The wing rails 5 are fixed on the base plate 11 in a known manner by means of supporting members 12 being connected with the wing rail by a screw connection 13 and being connected with the base plate 11 by means of a screw connection 8. The base plates 11 have at their front surfaces facing the point 3 recesses 14 into which can enter the recessed portion 10 of the rail foot 9 of the point 3 in its position engaging the wing rail. On account of such overlapping of the base plate 11, any lifting movement of the point 3 is avoided and the base plate 11 thus acts as a jack pressing down the point in its position engaging the wing rail.

Figure 3:
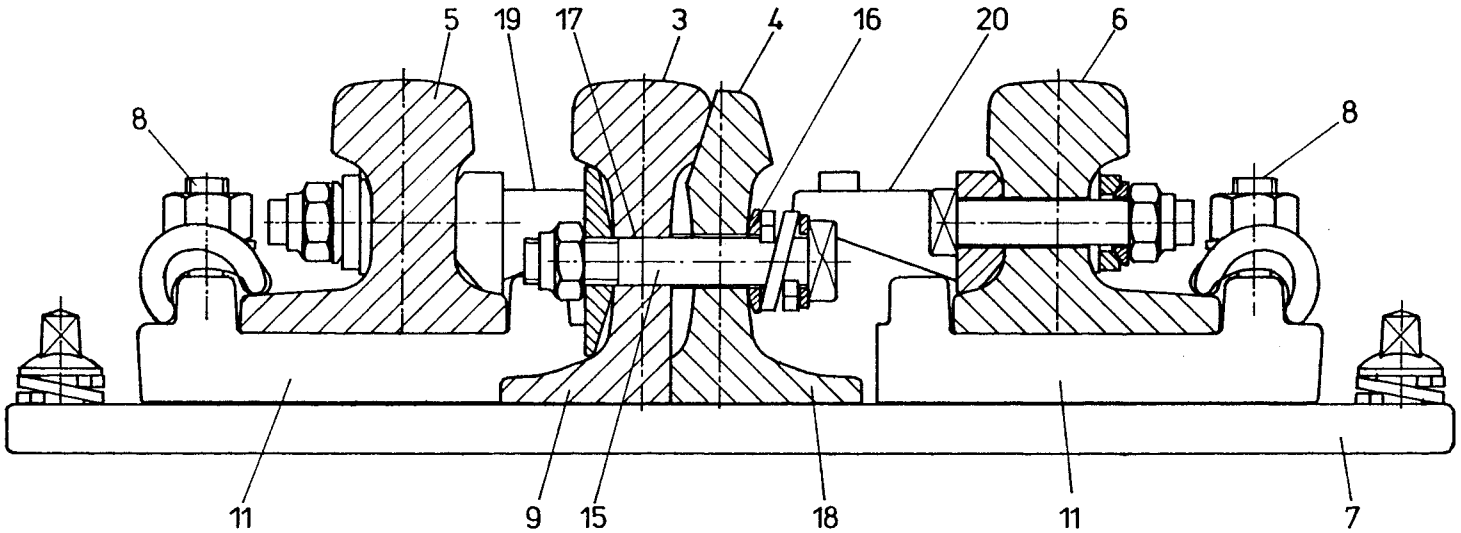
FIG. 3 shows a cross-section along the line III—III of FIG. 1.

In the respesentation according to FIG. 3, the connection between the main point 3 and the auxiliary point 4 is shown in greater detail. The auxiliary point 4 is, like the main point 3, formed, as explained above, by using thick-web standard rail sections. The wing rails 5 and 6 again have a smaller height and show an asymmetric tongue profile and are mounted on the sleepers 7 with interposition of base plates 11. As can be seen in FIG. 3, the main point 3 and the auxiliary point 4 are connected by a screw connection 15, noting that the hole 16 for the screw 15 is designed in the auxiliary point 4 as an elongated hole extending in length direction of the rail section. For the purpose of admitting relative shifting movement between the main point and the auxiliary point, the screw is connected with a bushing contacting the screw head and the rail web of the main point for giving a connection of high strength, while the auxiliary point is pressed against the main point by means of spring elements. The hole in the main point 3 is designed as a simple bore 17. Like the main point, the auxiliary point 4 has a rail foot 18 for the purpose of giving the frog a more stable design with reduced danger to tilting movement. Transmission of lateral forces from the points 3 and 4 onto the respective wing rails 5 and 6, respectively, is effected via supports 19 and 20 which can be fixed on the wing rail and on the frog point, respectively. These supports are also indicated in FIG. 1 and are there likewise designated by the reference numerals 19 and 20, respectively.

For the purpose of providing a support between main point 3 and auxiliary point 4 at a great distance from the tip area, there distance members 21 are provided, being schematically shown in FIG. 1. These distance members may alternately be fixed on one side of the main point and of the auxiliary point, so that the respective opposite engaging surface can, during the switching operation, slide on the thick-web standard rail section of the other point on account of the relative shifting movement between the main point and the auxiliary point.

On account of the main points and auxiliary points being designed as thick-web standard rail sections, these constructional elements are superior in their load carrying capacity over known movable frog points. Furthermore, on account of using such frogs, the construction length of such frogs can substantially be reduced, because the relative shifting movement during the switching operation can be brought into the area between the main point and the auxiliary point, because the mechanically worked thick-web sections have a sufficient load carrying capacity. On account of using thick-web standard sections for the main point and auxiliary point 3 and 4, respectively, the profile shape can be continuous from the beginning of the point till the end of the switch, so that exact, predictable bending lines and shapes of a travelling edge, respectively, are created during a switching operation. The main point 3 and the auxiliary point 4 are thus continuous elastic switch components without rigid disturbing areas. On account of using thick-web standard rail sections for the main point 3 and the auxiliary point 4, it is also possible to give spring locations in the rail foot, such locations not being shown for clarity's sake, a relatively short length and to arrange such locations at a relatively great distance in forward direction without allowing the switching forces to become inadmissibly high. Such length reduction has furthermore a favourable influence on the total construction length of the frog point 2. On account of the elastic design of the complete frog by means of thick-web standard rail sections as points 3 and 4 and, respectively, by means of asymmetric sections for the wing rails 5 and 6, the frog enters the elastic behavior of the track and represents no foreign body within the elastic track.

The main point 3 and the auxiliary point 4 formed of the thick-web standard rail section extend either until the end of the frog point 2 and are adapted there to the standard rail section or have their end within the clamped area at a distance of two to three sleeper sections in front of the end of the frog and are, after having been adapted to the standard rail section, welded with the standard rail which extends till the end of the frog. The wing rail portions designed as an asymmetric tongue section of small height within the area of the frog 1 are either forged immediately in front of the frog point to be adapted from the low asymmetric tongue profile to the standard rail section or are mutually adapted and welded with a standard rail extending till the begin of the frog. The asymmetric tongue profile may, however, also extend until the beginning of the frog and be only there adapted to the standard rail section. Furthermore, the wing rail portions either extend as an asymmetric tongue profile until the end of the wing rail or are forged in accordance to the standard rail section or mutually adapted behind the running-over area behind the zone behind the frog points and welded with the standard rail extending until the end of the wing rail.

For the main points and the auxiliary points being formed of the thick-web standard rail section and for the wing rails being formed of the asymmetric tongue rail section of low height, there can be used either non-treated rail steels of natural hardness, special quality steels, heat-treated steels or austenitic manganese steel as rolled or cast which may also be pre-strengthened. In case of austenitic manganese steel, the adjoining standard rail, which is adjoining at the begin or at the end of the frog or, respectively, at the end of the wing rail, is connected to the respective track portion of the frog tip or, respectively, of the wing rail in accordance with special processes for welding austenitic manganese steel with rail steel.

In place of mounting the thick-web standard rail sections in a manner shown in the Figures, there may also be used a type of mounting which is designated as inner stock rail staying. The frog points 3 and 4 can also be fixed within the clamped area and within the area of the wing rails being formed of standard rail sections by means of internally arranged elastic clamping plates.

What is claimed is:

1. A railway switch comprising a frog with a movable main point and a movable auxiliary point, the main and the auxiliary points being formed of standard rail sections having a thick web, a first height and a rail foot, said railway switch further comprising outer wing rails being formed of asymmetric tongue sections having a second height, said second height being less than said first height, with said outer wing rails being at least partially fixed on base plates.

2. A railway switch as claimed in claim 1, wherein a difference in height between said first height and said second height is larger than a height of the rail foot of said standard rail sections having a thick web.

3. A railway switch as claimed in claims 1 or 2, wherein front sides of said base plates that face the movable main point and the movable auxiliary point include recesses for gripping the rail foot in an engaging position of the frog.

4. A railway switch as claimed in claim 1 or 2, wherein the rail foot is within an area defined by recesses in the base plates, said base plates having a smaller width due to said recesses.

5. A railway switch as claimed in claim 1 or 2, the railway switch further comprising means for screw connecting the main point and the auxiliary point, said screw connecting means extending through holes in mutually contacting surfaces of said main and auxiliary points, said holes extending in a longitudinal direction of said rail section, said screw connecting means including a supporting bushing and spring elements.

* * * * *